US005908171A

United States Patent [19]

Raudaskoski

[11] Patent Number: 5,908,171

[45] Date of Patent: Jun. 1, 1999

[54] METHOD AND APPARATUS FOR REDUCING THE FRICTION COEFFICIENT OF ROLL SPOOLS DURING WINDING OF A WEB

[75] Inventor: Vesa Raudaskoski, Järvenpää, Finland

[73] Assignee: Valmet Corporation, Helsinki, Finland

[21] Appl. No.: 08/875,144

[22] PCT Filed: Oct. 29, 1996

[86] PCT No.: PCT/FI96/00570

§ 371 Date: Jun. 30, 1997

§ 102(e) Date: Jun. 30, 1997

[87] PCT Pub. No.: WO97/16367

PCT Pub. Date: May 9, 1997

[30] Foreign Application Priority Data

Nov. 1, 1995 [FI] Finland ..... 955216

[51] Int. Cl.[6] ..... B65H 18/08; B65H 71/00

[52] U.S. Cl. ..... 242/530.1; 242/530.3; 242/908

[58] Field of Search ..... 242/530.1, 530.3, 242/530.4, 378.4, 388.6, 594.3, 594.4, 908

[56] References Cited

U.S. PATENT DOCUMENTS

| | | | |
|---|---|---|---|
| 916,162 | 3/1909 | Jenkins | 242/908 X |
| 2,379,495 | 7/1945 | Roesen | 242/908 X |
| 3,512,727 | 5/1970 | Palovaara | 242/66 |
| 3,554,457 | 1/1971 | Hutzenlaub | 242/530.3 |
| 3,837,593 | 9/1974 | Dörfel | 242/66 |
| 4,598,877 | 7/1986 | Oinonen | 242/66 |
| 5,190,235 | 3/1993 | Schönmeier et al. | 242/66 |

FOREIGN PATENT DOCUMENTS

| | | | |
|---|---|---|---|
| 49276 | 4/1974 | Finland . | |
| 742833 | 10/1943 | Germany . | |
| 1143074 | 1/1963 | Germany | 242/530.3 |
| 3924612 | 1/1991 | Germany . | |
| 67455 | 2/1944 | Norway . | |
| 9513980 | 5/1995 | WIPO . | |

*Primary Examiner*—John Q. Nguyen
*Attorney, Agent, or Firm*—Steinberg & Raskin, P.C.

[57] ABSTRACT

A method and apparatus in winding, wherein a number of separate rolls (13*a*, 13*b*, 13*c*, 13*d*, 13*e*, 13*f*) *are formed side by side around separate roll spools (*15*a*, 15*b*, 15*c*, 15*d*, 15*e*, 15*f*) *placed one after the other while supported by support numbers (*11, 12). In order to reduce the friction coefficient of the roll spools (15*a*, 15*b*, 15*c*, 15*d*, 15*e*, 15*f*) *before, or at the same time as, the roll spools are placed in the winding position, the ends of the roll spools are treated with an agent that reduces the friction coefficient, or pieces of a material that has a low friction coefficient are placed at the end of the roll spools, and/or the axial thrust force between the roll spools is lowered by passing a pressurized medium through the spool locks.*

20 Claims, 4 Drawing Sheets

METHOD AND APPARATUS FOR REDUCING THE FRICTION COEFFICIENT OF ROLL SPOOLS DURING WINDING OF A WEB

FIELD OF THE INVENTION

The invention concerns a method in winding, wherein a number of separate rolls are formed side by side around separate roll spools placed one after the other while supported by support members.

BACKGROUND OF THE INVENTION

Owing to variations in the cross-direction profiles, for example thickness, moisture and roughness, of the web to be wound, adjacent rolls are not formed with precisely equally large diameters, in spite of the fact that, in principle, precisely equally long component webs are wound into them. Owing to the different diameters of the rolls, the roll spools placed in the roll centers are displaced with the progress of winding in relation to one another so that their centers of rotation are separated and, at the same time, minor variations occur in the angular speeds of the rolls. Since the roll centers are, however, during the entire winding process, in contact with each other, diverting forces arise between the ends of the roll spools, and the rolls tend to "jump", in which connection the rolls that are being formed can be damaged. Owing to this detrimental oscillation, in carrier-drum winding, it is, as a rule, necessary to run at a lower speed, i.e. to be content with a lower winding speed. which reduces the capacity of the machine and is, thus, uneconomical.

The problem described above has occurred as long as winders of the carrier drum type have been in use. The seriousness of the problem has, however, varied in the course of years, because the profile of the web produced in a paper machine has improved and, at the same time, the roll size and the winding speed have changed to a little extent only. In recent years, the diameters of the customer rolls produced have started becoming ever larger and, at the same time. the winding speeds have also increased, for which reason the problem of oscillation has been noticed again: even a little variation of profile in the direction of width of the web is cumulated especially during winding of thin paper grades so that faults in the shape of the rolls which arise from the web profile cause a significant oscillation problem.

In the winding process, a number of different phenomena are effective which attempt to shift the web rolls that are being formed in their axial direction:

- deflection of the winding cylinders. i.e. carrier drums,
- faults in the shape of the rolls arising from uneven profile of the web, and
- also the spool locks, which support the roll spools of the lateral web rolls, subject the row of rolls to axial forces when they keep the row of rolls in the desired location.

The spool locks alone can also produce a compression force applied to the whole row of roll spools when the roll spools are excessively long: the total length of the roll spools is higher than the regulated distance between the spool locks.

The phenomena described above can, either alone or together, produce situations in which the ends of the roll spools of the rolls tend to be pressed against each other and thereby to produce a relative support force.

Thus, there are several factors that produce a relative axial thrust force between the rolls. The spool locks, which keep the lateral roll spools in their positions, keep the row of rolls in the correct winding position in the lateral direction, but deflection of the carrier drums drives the rolls towards the lowest point of deflection. Variations in the web profile produce a "carrot shape" even in individual rolls, in which case the rolls tend to move in the lateral direction. Of course, variations in the lengths of the roll spools, together with the spool locks, cause variation in the axial forces in different forms. It comes out from the above that there are a number of different reasons why the rolls tend to be pressed against each other during winding.

In prior-art solutions, attempts have been made to attenuate the detrimental oscillation occurring in carrier-drum winders by various means. In the Patent DE-742,833 (granted Dec. 29, 1943), the problem of oscillation of the rolls formed by winders of the carrier-drum type has been described, and a solution has been described for reducing the oscillation. In this prior-art solution, the rolls are pressed lightly by means of a cutting roll which operates as an extra support roll, whereby attenuation of the oscillation of the rolls is produced.

A similar attenuation of oscillation produced by means of a separate roll has been applied in the Patent DE-3,924,612.

With respect to the prior art, reference is also made to the publications FI-841448 and FI-49,276, in which some typical carrier-drum winders are described, in which, of course, the detrimental oscillation problem of carrier-drum winders occurs.

It is a second prior-art mode of eliminating the problem of oscillation that relative movements of the roll spools constituting the centers of the rolls are prevented either so that an axle is placed inside the roll spools, which axle keeps the central axes of the rolls immobile in relation to one another, or so that the rolls are formed onto a continuous roll spool. In both modes, it is a drawback that separation of the rolls formed from one another causes significant additional work and, thus, also reduced productivity. Moreover, when winding takes place around the same center, the roll diameters become equally large, but, owing to variations in the cross-direction profile of the web, their internal tightness varies. This is not desirable in the procedures of further processing of the rolls.

The problems described above occur in all such winder types in which the location/support of the web rolls that are formed comply with the following terms:

- the roll spools (web rolls) are placed one after the other coaxially so that the location of each roll spool is determined by means of the adjacent roll spools.
- the roll spools (web rolls) are supported under optimal conditions in the radial direction of the rolls only (the spool locks just prevent axial movement arising from faults in the roll shapes and from deflection of the winding members).

OBJECTS AND SUMMARY OF THE INVENTION

The object of the present invention is to provide an improvement of the method described above in winding. It is a specific object of the invention to provide a method which solves the detrimental problem of oscillation occurring. for example in carrier-drum winding better than in the prior-art solutions.

The objectives of the invention are achieved by means of a method which is characterized in that, in order to reduce the friction coefficient of the roll spools, before, or at the same time as, the roll spools are placed in the winding position, the ends of the roll spools are treated with an agent that reduces the friction coefficient, or pieces of a material that has a low friction coefficient are placed at the ends of the roll spools, and/or the axial thrust force between the roll spools is lowered by passing a pressurized medium through the spool locks.

In the solution in accordance with the invention, it has been realized to reduce the impulse that causes the oscillation. This is why, in carrier-drum winders, as a rule, it is no longer necessary to use various solutions of attenuation of oscillation, which require separate solutions of additional equipment and, thus, result in additional costs. Thus, in the present invention, it has been noticed that the intensive oscillation of the rolls during winding arises primarily from the relative movements of the roll spools and from the friction forces between the roll spools. In the present invention, it has been realized to reduce the friction forces between the roll spools.

In a preferred embodiment of the invention, the friction efficient is lowered by lubricating the ends of the roll spools with oil, which is absorbed into the end of the roll spool and which reduces the friction coefficient between the ends of the roll spools, in which connection the friction force is also lowered, and so also the impulse that produces the detrimental oscillation. Of course, according to the invention, the friction coefficient can also be lowered by means of other substances that are applied to the ends of the roll spools and that lower the friction coefficient, for example by means of waxes or fats.

In a second preferred embodiment of the invention, the contact force, i.e. the axial thrust force, between the ends of the roll spools, is lowered by feeding a pressurized medium, preferably compressed air, into the row formed by the roll spools, for example, through the spool locks, in which connection the compressed air discharged between the roll spools attempts to keep the rolls that are being formed apart from one another and thereby reduces the friction force between the roll spools. For example, if the set of spools is "excessively long", the supply of compressed air also reduces the axial thrust forces of the spool locks and, thus, the impulse that causes the detrimental oscillation.

The most significant advantage that is obtained by means of the invention is therein that, when the impulse that causes the oscillation is reduced substantially in carrier-drum winders it is, as a rule, unnecessary to lower the winding speed, i.e. to reduce the capacity of the machine.

The invention will be described in detail with reference to some preferred embodiments of the invention illustrated in the figures in the accompanying drawings, the invention being, however, not supposed to be confined to said embodiments alone.

DETAILED DESCRIPTION OF THE PREFERRED EMBODIMENTS

Figure 1:
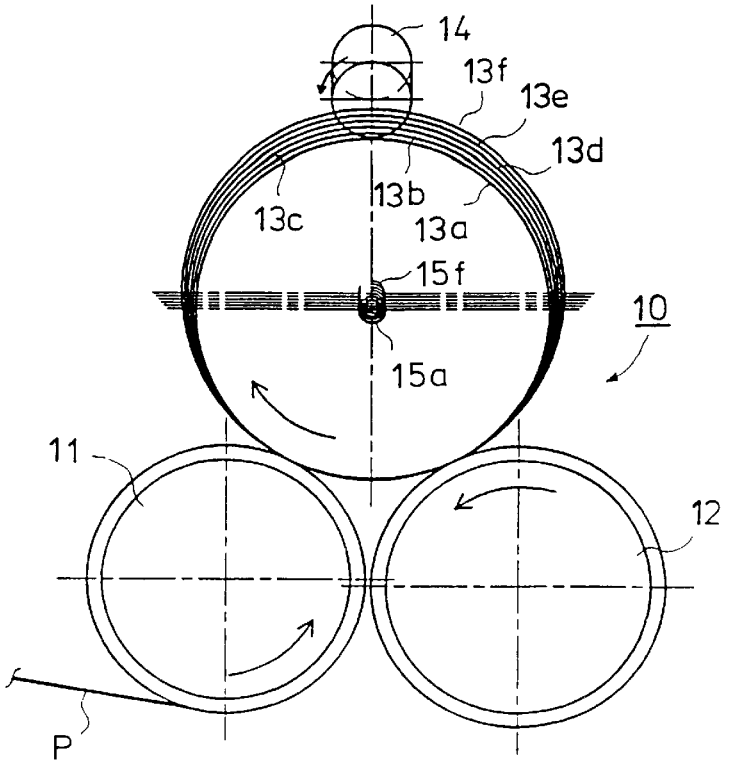
FIG. 1 (PRIOR ART)
FIG. 1 is a schematic side view of a conventional carrier-drum slitter-winder.

In FIGS. 1 . . . 4, the carrier-drum slitter-winder is denoted generally with the reference numeral 10. The carrier-drum slitter-winder comprises a first carrier drum 11 and a second carrier drum 12. The rolls that are being formed are denoted with the reference numerals 13*a*,13*b*,13*c*,13*d*,13*e* and 13*f*. The reference numeral 14 denotes the rider roll. The roll spools of the rolls are denoted with the reference numerals 15*a*,15*b*,15*c*,15*d*,15*e* and 15*f*. The spool locks that prevent axial movements of the lateral rolls are denoted with the reference numeral 16.

The distance s between the web rolls is regulated by means of a web separation device before the winding, so that the rolls do not adhere to one another as a result of relative overlapping of the separate webs.

Figure 2:
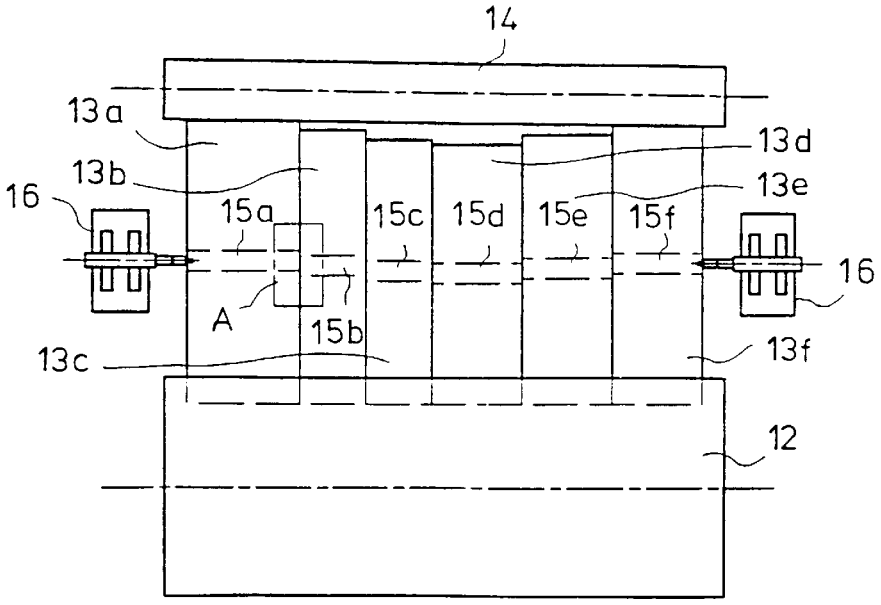
FIG. 2 (PRIOR ART)
FIG. 2 is a schematic illustration viewed from ahead of a problem occurring in a carrier-drum slitter-winder as shown in FIG. 1.
Figure 3:
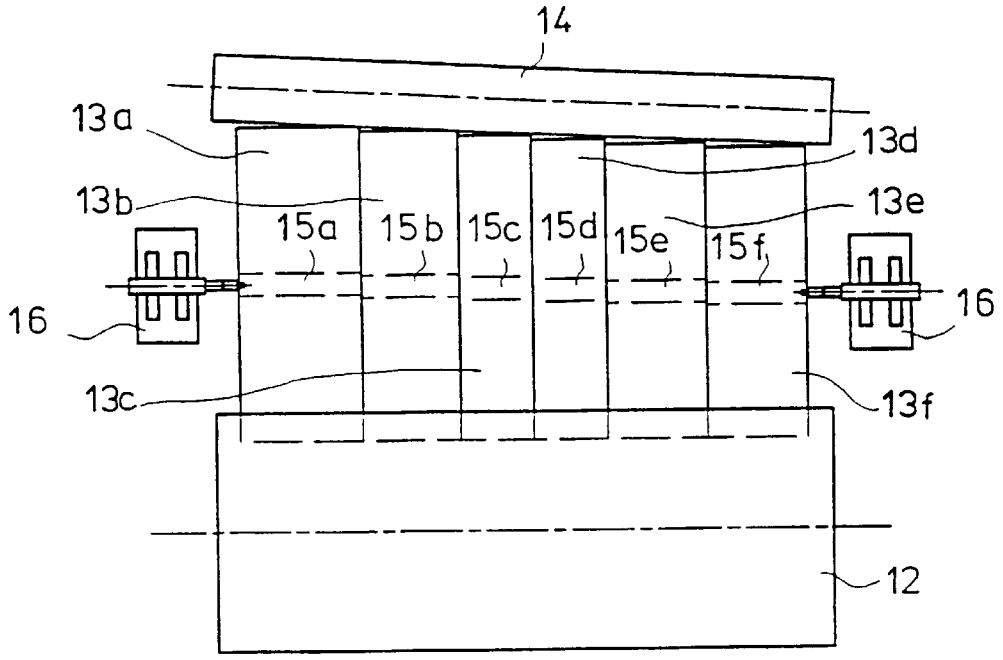
FIG. 3 (PRIOR ART)
FIG. 3 is a schematic illustration viewed from ahead of a second problem occurring in a carrier-drum slitter-winder as shown in FIG. 1.

FIGS. 2 and 3 show the differences in web roll diameters arising from two different profiles of material web, which differences in diameters cause shifting of the roll spools 15*a*,15*b*,15*c*,15*d*,15*e* and 15*f* so that their axes of rotation are not on the same line, compared with one another.

Figure 4:
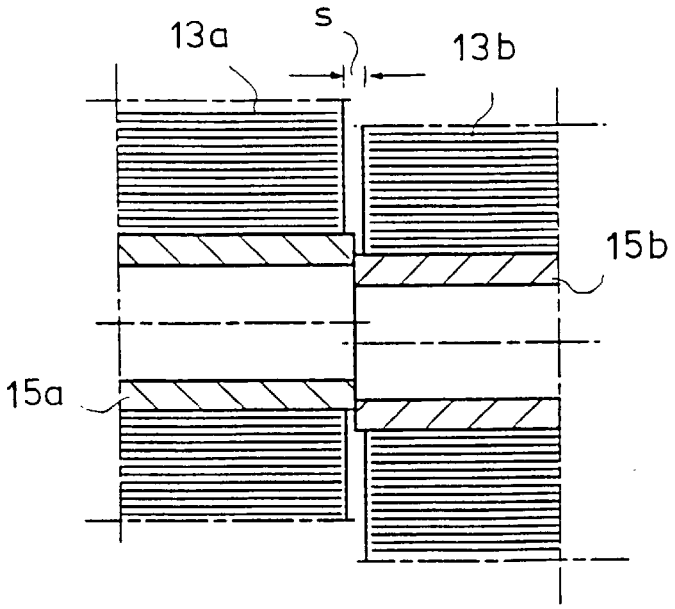
FIG. 4 (PRIOR ART
FIG. 4 is a schematic illustration on an enlarged scale of the detail A taken from FIG. 2 and showing the way in which the ends of two adjacent roll spools contact each other.

In FIG. 4 it is shown how the ends of, for example, the roll spools 15*a* and 15*b* reach contact with one another. The distance between the rolls 13*a* and 13*b* is denoted with the letter s.

Figure 5:
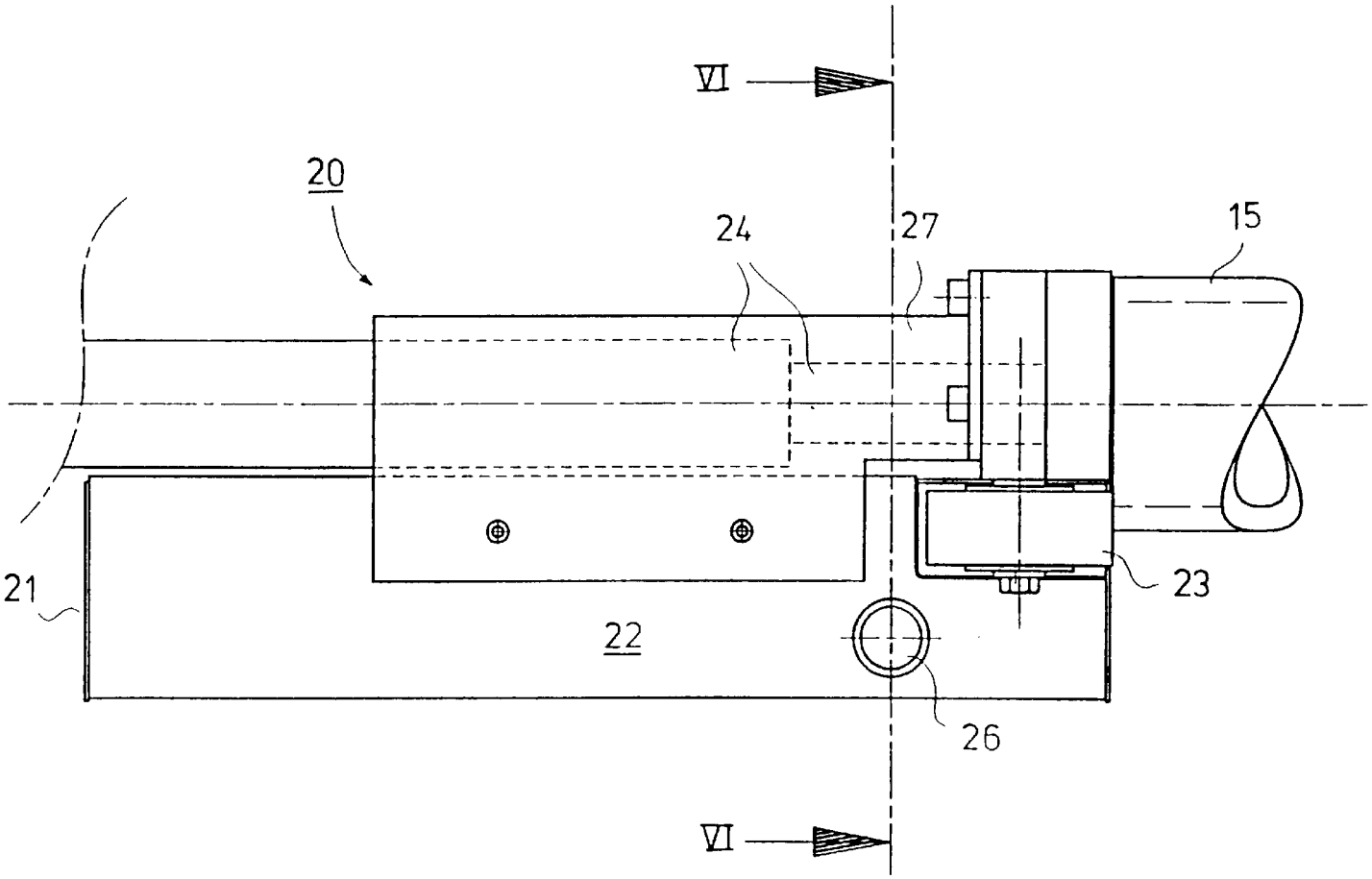
FIG. 5 is a top view of a preferred solution of equipment for treatment of the ends of the roll spools with an agent that lowers the friction coefficient.
Figure 6:
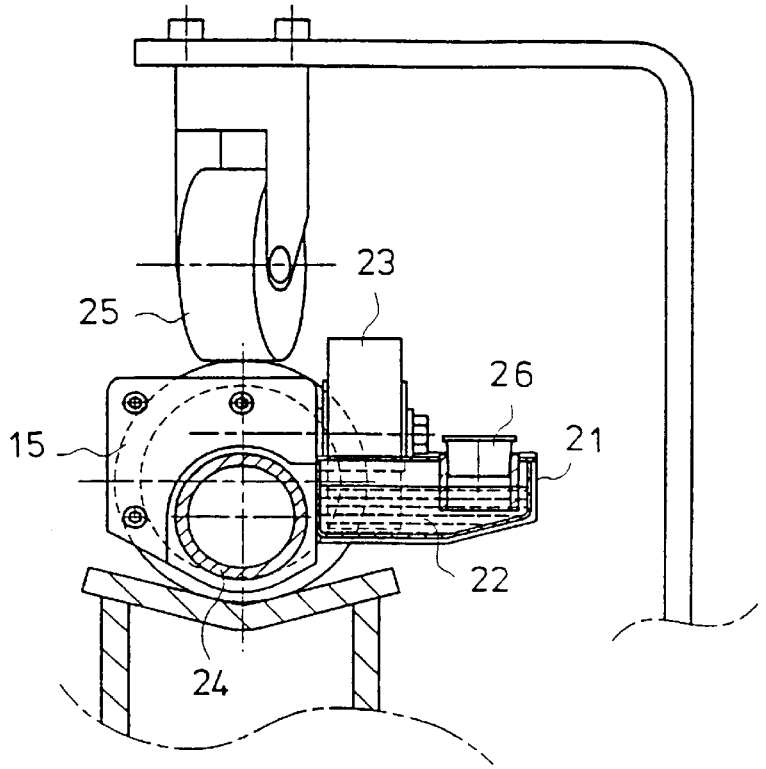
FIG. 6 is a sectional view taken along the line VI—VI in FIG. 5.

In FIGS. 5 and 6, the device for treatment of the ends of the roll spools with an agent that lowers the fiction coefficient is denoted generally with the reference numeral 20. In this embodiment the device 20 comprises an oil space 21, in which there is oil 22. The reference numeral 23 denotes the roll, i.e. the oil transfer wheel, and the reference numeral 24 denotes the spool pusher. The reference numeral 26 denotes the filling opening and the plug of the oil tank 21. The reference numeral 27 denotes the plate between the spool pusher 24 and the oil tank 21. During the pushing movement, the roll 23 that is in an oil bath transfers oil 22 to the end of the roll spool 15. The reference numeral 25 denotes the wheel that rotates the spool, by means of which wheel the revolving movement of the roll spool 15 is produced. Owing to the solution, the end of the roll spool 15 is lubricated very well with oil, in which connection the friction coefficient between the ends of the roll spools 15 is lowered to a considerable extent.

Figure 7:
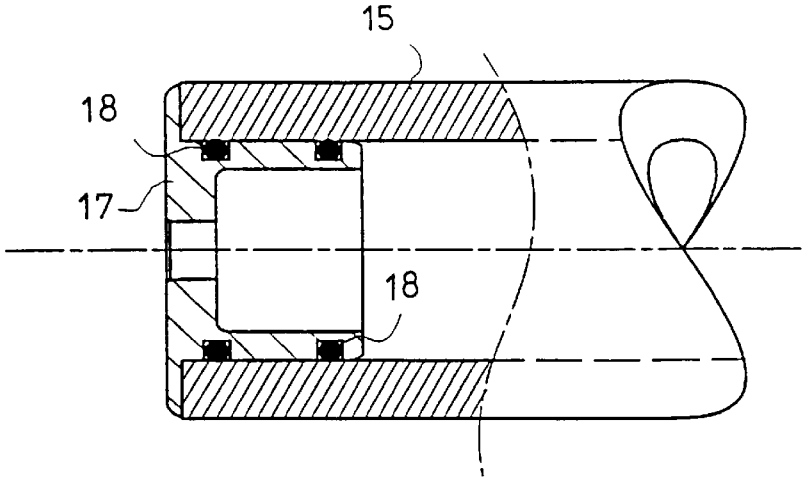
FIG. 7 shows a second preferred embodiment for treatment of the ends of the roll spools in a way that lowers the friction coefficient.

In the embodiment shown in FIG. 7, the friction coefficient of the end of the roll spool 15 is lowered by to the end of the roll spool 15 fitting an end piece 17 that has a low friction coefficient. In this embodiment, a flange-shaped or sleeve-shaped end piece 17 has been used, which has been attached to the roll spool 15 by means of O-ring seals 18.

Above, just some preferred embodiments of the invention have been described, and it is obvious to a person skilled in the art that numerous modifications can be made to said embodiments within the scope of the inventive idea defined in the following patent claims.

I claim:

1. A method in winding, wherein a number of separate rolls are formed side by side around separate roll spools placed axially one after the other while supported by first and second carrier drums characterized in that, in order to reduce the friction coefficient of the roll spools during winding when the ends of the roll spools are liable to contact one another before, or at the same time as, the roll spools are placed in the winding position, the ends of the roll spools are treated with an agent that reduces the friction coefficient, or pieces of a material that has a low friction coefficient are placed at the ends of the roll spools, and/or axial thrust force between the roll spools is lowered by passing a pressurized medium through the spool locks.

2. A method as claimed in claim 1, characterized in that oil is used as the agent that lowers the friction coefficient.

3. A method as claimed in claim 1, characterized in that a wax is used as the agent that lowers the friction coefficient.

4. A method as claimed in claim 1, characterized in that a fat is used as the agent that lowers the friction coefficient.

5. A method as claimed in claim 1, characterized in that flange-shaped members (17) that are fitted to the ends of the roll spools **(15*a*,15*b*,15*c*,15*d*,15*e*,15*f*)** are used as the pieces of material that lower the friction coefficient.

6. A method as claimed in claim 1, characterized in that compressed air is used as the pressurized medium.

7. In a method for winding a material web in which a plurality of separate rolls are formed each around a respective roll spool, the rolls being arranged one after another and side by side such that at least two of the roll spools are axially adjacent one another, the rolls being supported by first and second carrier drums, the improvement comprising the step of:

reducing friction between ends of the adjacent roll spools during winding of the web onto the adjacent roll spools when the ends of the roll spools are liable to contact one another.

8. The method of claim 7, wherein said friction reducing step comprises the step of treating the ends of at least one of the adjacent roll spools with an agent that reduces the friction coefficient of the material of the at least one roll spool during winding of the web onto the adjacent roll spools.

9. The method of claim 8, further comprising the step of utilizing oil as the agent that reduces the friction coefficient of the at least one roll spool.

10. The method of claim 8, further comprising the step of utilizing wax as the agent that reduces the friction coefficient of the at least one roll spool.

11. The method of claim 8, further comprising the step of utilizing a fat as the agent that reduces the friction coefficient of the at least one roll spool.

12. The method of claim 7, wherein said friction reducing step comprises the step of prior to winding of the web onto the adjacent roll spools, arranging a material having a friction coefficient lower than the friction coefficient of the material of the roll spool at least at one of the ends of at least one of the adjacent roll spools in contact with an opposed roll spool.

13. The method of claim 12, further comprising the step of inserting a flange-shaped member into the at least one end of the roll spool, said flange-shaped member providing the material having a friction coefficient lower than the friction coefficient of the material of the roll spools.

14. The method of claim 7, wherein said friction reducing step comprises the step of directing a pressurized medium from a spool lock preventing axial movement of the rolls through the roll spools to lower axial thrust between the adjacent roll spools during winding of the web onto the roll spools, the pressurized medium being discharged between the adjacent roll spools to thereby reduce the friction force between the adjacent roll spools.

15. The method of claim 14, further comprising the step of utilizing compressed air as the pressurized medium.

16. In an apparatus for winding a material web in which a plurality of separate rolls are formed each around a respective roll spool, the rolls being arranged one after another and side by side such that the roll spools are axially adjacent one another, the rolls being supported by first and second carrier drums, the improvement comprising;

means for reducing the friction between ends of the adjacent roll spools during winding of the web onto the adjacent roll spools when the ends of the roll spools are liable to contact one another.

17. The apparatus of claim 16, wherein said means comprise a receptacle receivable of a liquid substance and a transfer wheel for transferring the liquid substance from said receptacle to the ends of the adjacent roll spools.

18. The apparatus of claim 17, wherein the liquid substance is oil.

19. The apparatus of claim 16, wherein said means comprises a flange-shaped end piece inserted at least partially into the ends of each of the adjacent roll spools prior to the winding of the web onto the adjacent roll spools, said end pieces being made of a material having a friction coefficient lower than the friction coefficient of the material of the adjacent roll spools such that friction between the ends of the adjacent roll spools is reduced during winding of the web onto the adjacent roll spools.

20. The apparatus of claim 16, wherein said means comprise spool locks engaging with axial ends of the adjacent roll spools, said spool locks being structured and arranged to direct a pressurized medium through the adjacent roll spools to be discharged between the adjacent roll spools to thereby reduce the friction force between the adjacent roll spools.

* * * * *